US008585456B2

(12) United States Patent
Canon

(10) Patent No.: US 8,585,456 B2
(45) Date of Patent: Nov. 19, 2013

(54) DISPLAY PACKAGING FOR SOFT TOYS

(75) Inventor: Dennis Patrick Canon, Cerritos, CA (US)

(73) Assignee: Disney Enterprises, Inc., Burbank, CA (US)

( * ) Notice: Subject to any disclaimer, the term of this patent is extended or adjusted under 35 U.S.C. 154(b) by 337 days.

(21) Appl. No.: 12/887,708

(22) Filed: Sep. 22, 2010

(65) Prior Publication Data

US 2012/0071060 A1 Mar. 22, 2012

(51) Int. Cl.
*A63H 33/16* (2006.01)
*A63H 33/00* (2006.01)

(52) U.S. Cl.
USPC ..... 446/73; 446/80

(58) Field of Classification Search
USPC ..... 446/71–73, 75, 76, 77, 80
See application file for complete search history.

(56) References Cited

U.S. PATENT DOCUMENTS

| | | | | | |
|---|---|---|---|---|---|
| 1,361,628 | A * | 12/1920 | Shailer | 229/116.3 |
| 1,640,260 | A * | 8/1927 | Vogel | 446/268 |
| 3,699,712 | A * | 10/1972 | Handler et al. | 446/325 |
| 4,319,424 | A * | 3/1982 | Goldfarb et al. | 446/268 |
| 4,782,950 | A * | 11/1988 | Santoro | 206/457 |
| 4,969,821 | A * | 11/1990 | Smith | 434/433 |
| 5,209,694 | A * | 5/1993 | Utt, Jr. | 446/73 |
| 5,224,894 | A * | 7/1993 | Nelson et al. | 446/73 |
| 6,761,612 | B1 * | 7/2004 | Pencil et al. | 446/310 |
| 7,682,216 | B2 * | 3/2010 | Spector | 446/147 |

* cited by examiner

*Primary Examiner* — Kien Nguyen
(74) *Attorney, Agent, or Firm* — Ference & Associates LLC

(57) ABSTRACT

Display packaging for soft toys, in particular, dolls, that allows a doll to be stably displayed upright in a standing or upright position on a retail display shelf, while allowing the doll's costumes and other attributes to be displayed to a purchaser and/or and child accompanying the purchaser unimpeded by any packaging elements and in a more life-like manner is described.

22 Claims, 10 Drawing Sheets

DISPLAY PACKAGING FOR SOFT TOYS

BACKGROUND

The rapid and virtually unlimited development of toy products within the marketplace has been largely matched by the development of innovative product packaging and product packaging techniques. Toys, for example, have become increasingly entertaining, amusing, colorful and sophisticated and packaging for such toy products have often been developed to make the packaging more colorful, informative, eye-catching and entertaining.

The display of soft toys or soft dolls in particular has traditionally posed certain problems due to the fact that the dolls are generally haphazardly placed onto a retailer's shelves, or if the dolls are neatly arranged they become disarrayed or fall over as customers move them when they are moved and removed from the shelf for purchase. Thus, a neat and orderly display of such dolls in a standing or upright position is desired so as to enhance the appearance of the dolls at the point of purchase.

Additionally, in the case of soft dolls, the doll's costumes which may include items such as long dresses or gowns, flowing hair, and head decorations are often times obscured by the doll's packaging which impedes the purchaser, and/or a child accompanying the adult purchaser, from viewing the entirety of the doll's appearance. Particularly in the case of dolls based on well-known animated or fairy tale characters, the entire appearance of the doll, including its pose, is particularly important since a purchaser and/or child will be viewing the overall appearance of the doll in order to match the doll's appearance with the corresponding familiar character image known from cinema, print media, or other sources. Adopting packaging which places the doll in a stable standing or upright position in a particular pose and which allows it to have its costume elements such as a long dress and hair to flow in a more life-like and attractive manner without obstructing the views thereof is therefore advantageous.

It is also important to maintain a focus on the environmental impact of packaging, i.e., the particular materials used and whether they are used minimally so as to respond to environmental concerns

BRIEF SUMMARY

Broadly contemplated herein, at least one presently preferred embodiment is directed to display packaging for soft toys, in particular, dolls, which allows a doll to be stably displayed in a standing or upright position on a retail display shelf, while allowing the doll's costume and other attributes to be displayed to a purchaser and/or and child accompanying the purchaser unimpeded by any packaging elements and in a more life-like manner.

In summary, one embodiment provides display packaging for a soft doll in a standing position that includes an enclosure box for holding a support base to which a doll support tower is affixed. The doll's feet and hips are inserted into the doll support tower and any long dress or gown is allowed to flow freely down into the enclosure box thereby covering the entirety of the support tower. The doll support tower comprises a four-sided truncated pyramidal structure through which the feet and hips of the doll are inserted. The lower portion of the front face of the tower is provided with a gripping and support structure and is folded inwardly perpendicularly to a substantially horizontal position approximately midway up the tower and fastened into place to grip and support the legs of the doll. The top of the support tower is provided with gripping support devices for gripping and supporting the doll's hips so that the upper part of the doll is free of supports thereby allowing any long costume dress or gown to flow downward unimpeded over the doll support tower. The doll can be viewed from all sides at point of sale.

Another embodiment provides display packaging for an imaginary creature, such as a mermaid, which does not have legs, or other types of characters which may have non-human attributes and/or may not have a long dress or gown. An enclosure box holds a support base to which is affixed a doll support tower which forms a cradle structure with longitudinal tabs formed on both sides of a back section. The tabs on the tower are folded inward to provide locking support for the front, sides, and back hips of the doll and a back section with a substantially cutout area that provides a downwardly extending support tab for both supporting the lower extremities of the doll, such as a mermaid's tail and fin, and for additionally securing the doll support tower to the support base that is held in the bottom of the enclosure box.

The display packaging containing the dolls can stand on a retail shelf in an orderly manner and allows the dolls to be seen virtually in their entirety and in a more life-like manner than when housed in conventional packaging.

For a better understanding of exemplary embodiments together with other and further features thereof, reference is made to the following description, taken in conjunction with the accompanying drawings, and the scope of the claimed embodiments will be pointed out in the appended claims.

DETAILED DESCRIPTION

Figure 1:
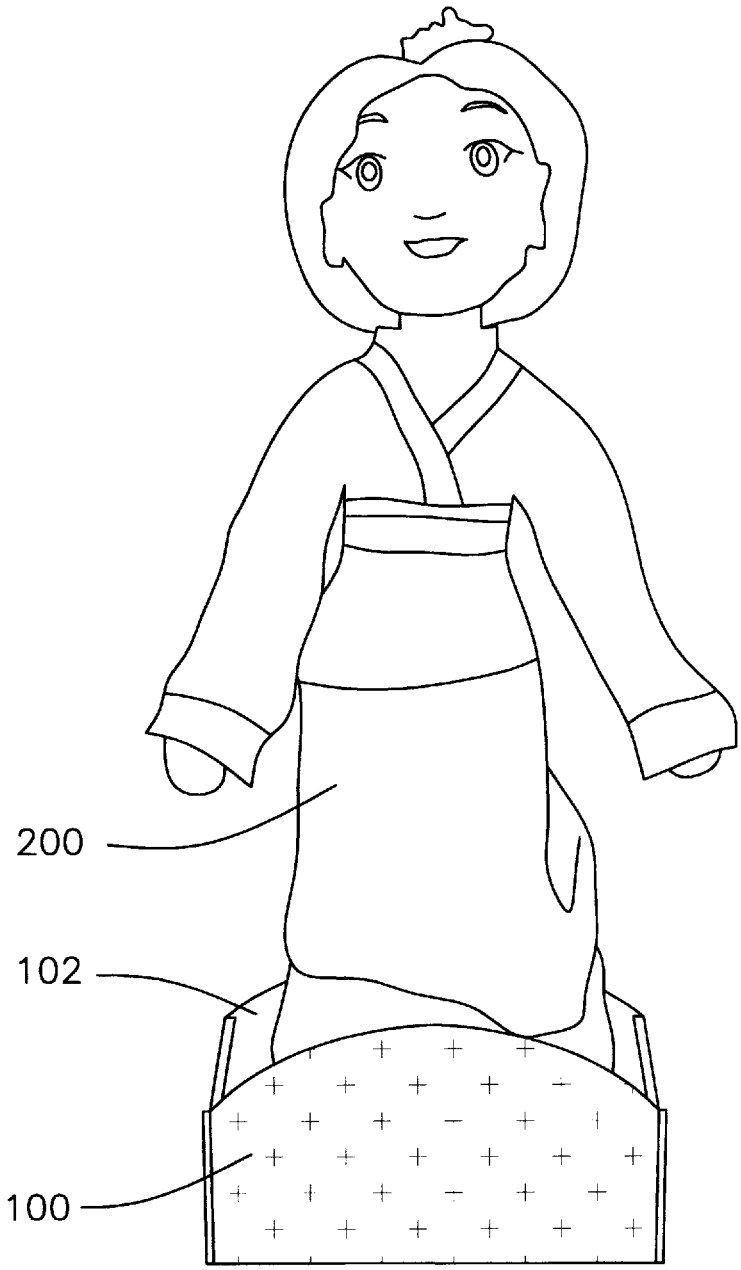
FIG. 1 shows a front view of display packaging containing a standing soft doll as it would sit on a retail shelf.

It will be readily understood that the components of the embodiments, as generally described and illustrated in the figures herein, may be designed in a wide variety of different configurations in addition to the described exemplary embodiments. Thus, the following detailed description of the embodiments, as represented in the figures, is not intended to limit the scope of the claims, but is merely for illustration of certain selected exemplary embodiments as claimed herein.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of the embodiments. One skilled in the relevant art will recognize, however, that the various embodiments can be practiced without one or more of the specific details, or with other methods, components, materials, et cetera. In other instances, well-known structures, materials, or operations are not shown or described in detail to avoid obscuring aspects of the embodiments.

The description now turns to the figures. The illustrated embodiments will be best understood by reference to the figures. The following description is intended only by way of example and simply illustrates certain exemplary embodiments as claimed herein.

The present invention is directed to display packaging for soft toys, particularly soft dolls, that allows the packaged doll to be neatly displayed on a retail shelf in a stable standing or upright position so that the doll's appearance is more life-like and not obscured by the packaging. In particular, in one embodiment the display packaging allows the physical attributes and costume of the doll, such as a long dress or gown, and long flowing hair, to be substantially fully displayed in a life-like manner unimpeded by packaging, including the back of the doll, prior to purchase. In another embodiment, a doll without a long dress or gown as part of its costume and which may be an imaginary creature that does not have legs is stably displayed in an upright position so that its frontal physical appearance is readily seen and is not obscured by the display packaging.

The materials for making the display packaging disclosed herein are not limited, but preferably flat suitable material such as, but not limited to, corrugated cardboard, paper, or any other substantially rigid and/or resilient material may be used. The surface of such materials may be capable of receiving or including graphical designs, a product description, trademark(s), bar code, or other indicia or printed material.

Figure 2:
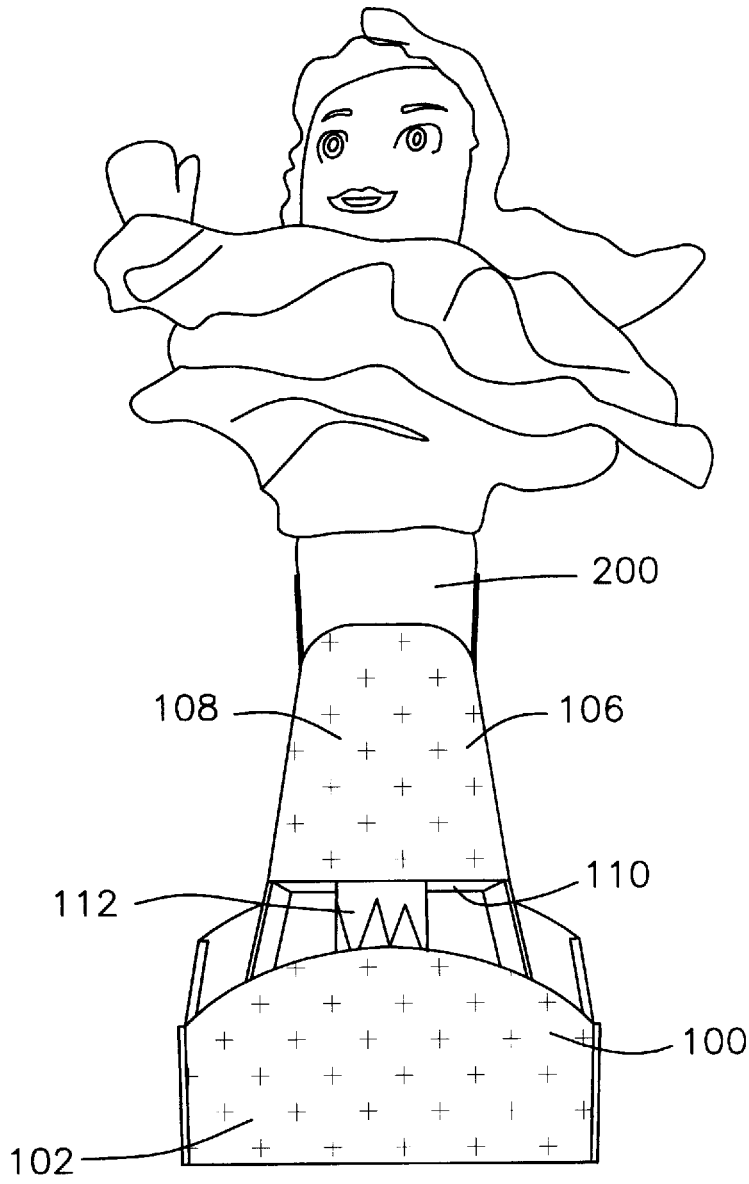
FIG. 2 shows a front view of the display packaging shown in FIG. 1 with the doll's dress moved upward to show the doll support tower structure.
Figure 3A:
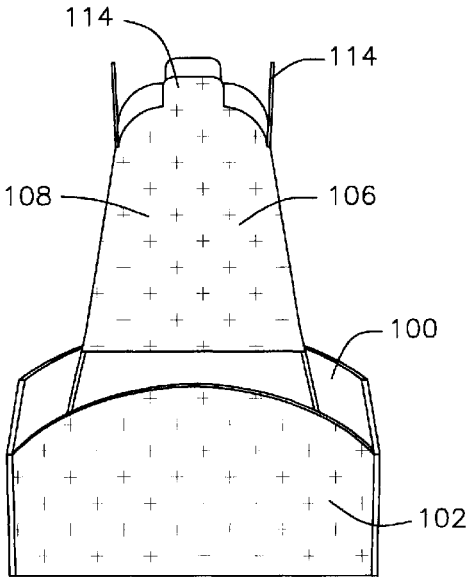
FIGS. 3A-3D show front, side, and three-quarter side view of the display packaging shown in FIGS. 1 and 2.
Figure 3B:
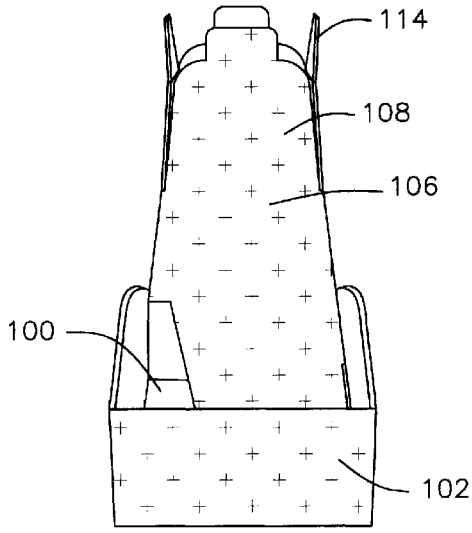
Figure 3D:
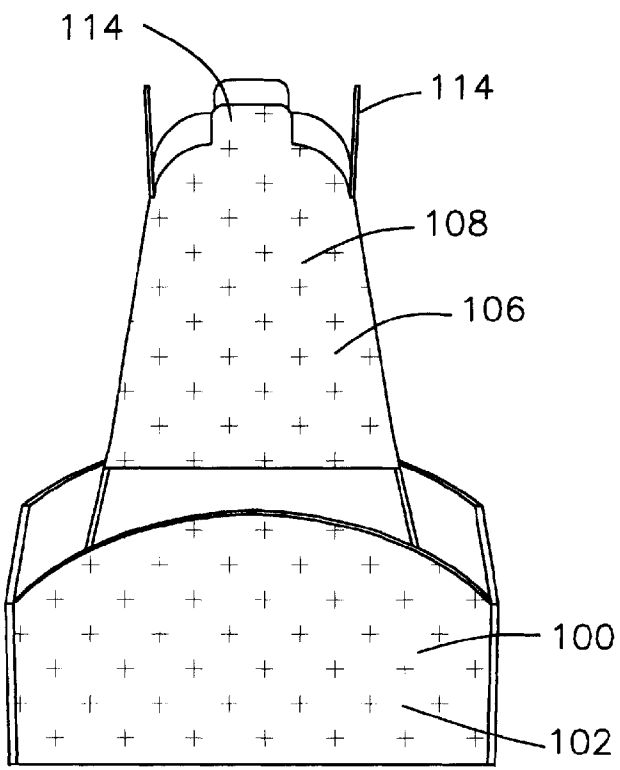
Figure 3C:
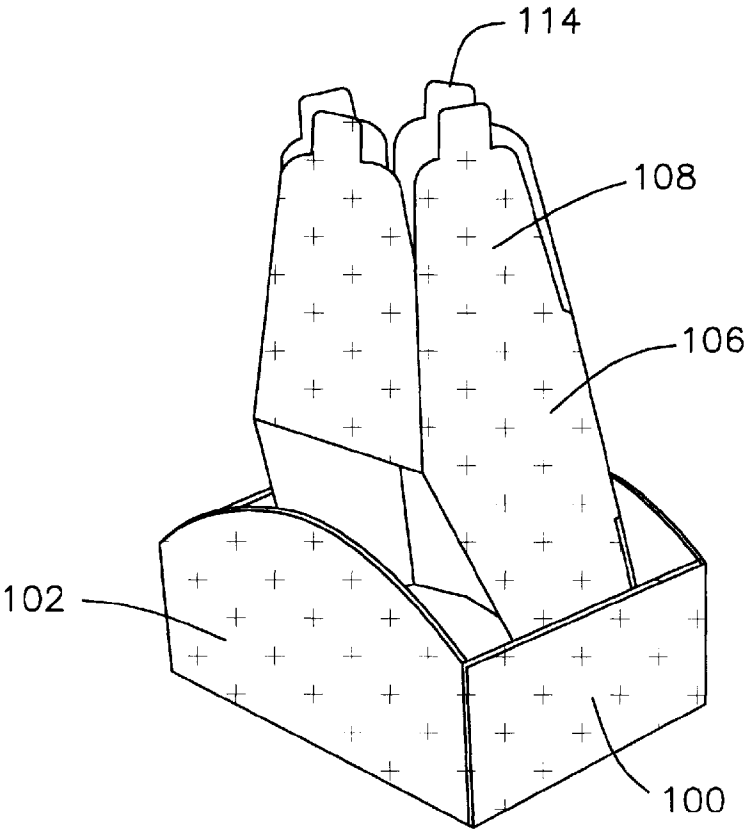

As shown in FIG. 1, one embodiment of display package or packaging 100 is shown as it would sit on a shelf at a retail store with a soft doll 200 housed within. Enclosure box 102 is generally flat on its bottom and is configured with four low sides. Enclosure box 102 receives a support base 104 (not shown) to which is attached a doll support tower 106 (not shown) which is covered by the doll's long dress. FIG. 2 shows enclosure box 102 into which doll support tower 106 and its support base 104 (not shown) have been inserted. The doll's dress has been lifted upward to show the four-sided pyramidal structure 108 of the doll support tower through which the doll's feet and hips are inserted. The bottom front face 110 of support tower 106 is provided with a gripping support structure 112 for gripping and supporting the doll's legs which is folded back perpendicularly to a substantially horizontal position approximately midway up the tower and secured to a surface of the back face of support tower 106 for additional structural support. The top edges of the support tower are provided with gripping support tabs 114 (not shown) that inwardly fold upon insertion of the doll for gripping and supporting the hips of the doll. The doll support tower has tabs on its lower edges (not shown) that fit into corresponding slots on the support base.

FIGS. 3A-3D respectively show front, side, three-quarter front, and back views of display packaging 100 showing the assembled doll support tower structure housed in enclosure box 102. The figures show gripping support tabs 114 on the top of the doll support tower that fold inwardly toward the doll when the doll is inserted downwardly therein to grip and support the doll's hips.

Figure 4A:
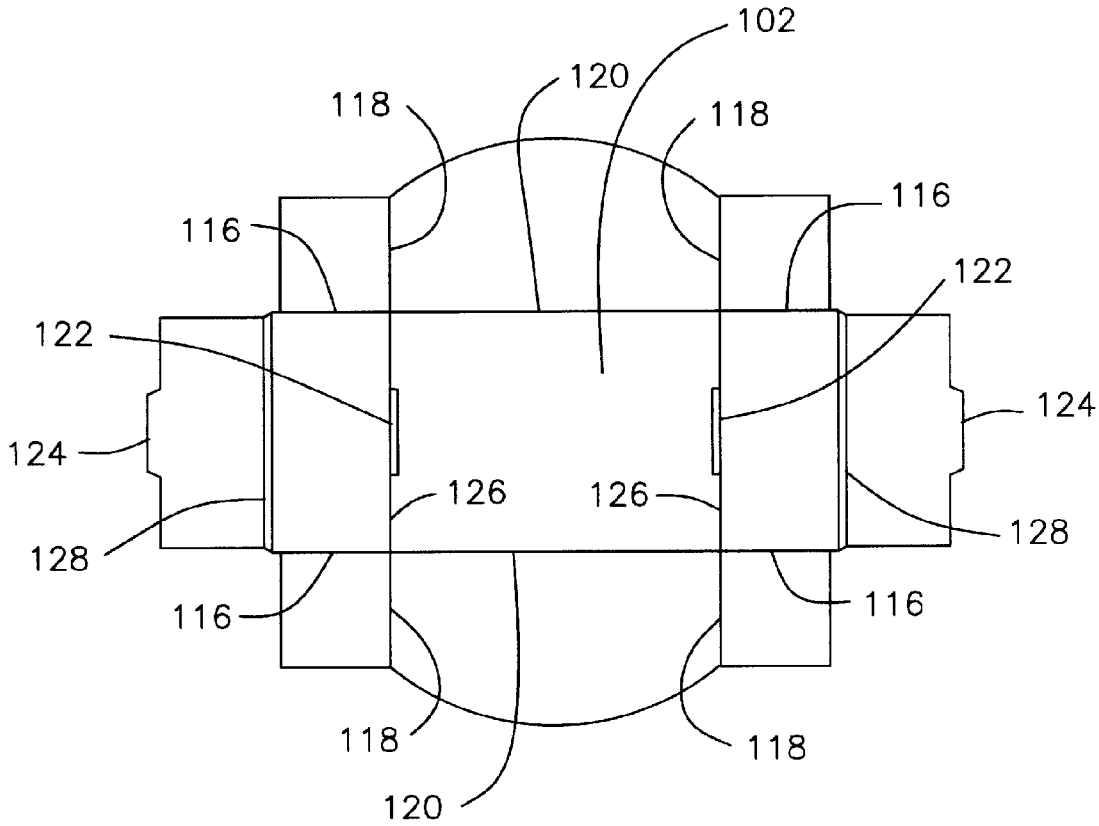
FIGS. 4A-4C are schematic drawings illustrating the structure of the display packaging of FIGS. 1-3.
Figure 4B:
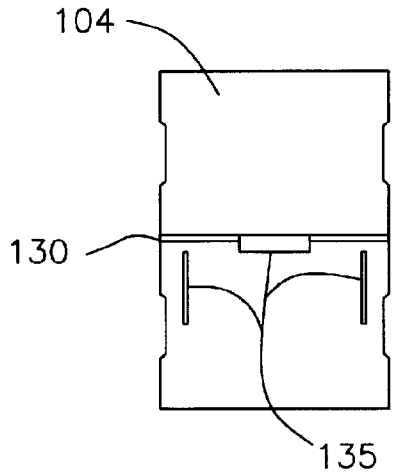
Figure 4C:
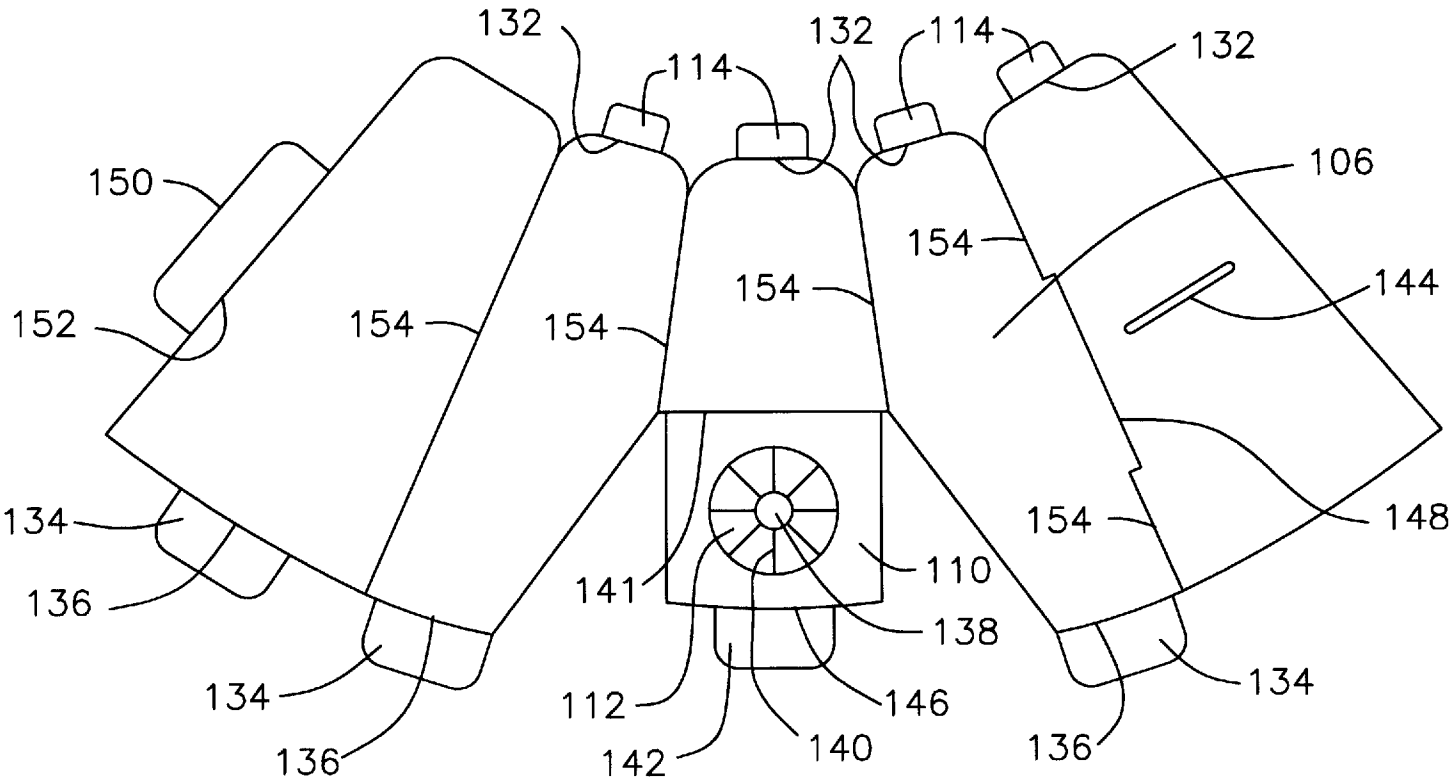

As an example of the process or method of making display packaging 100, FIGS. 4A-4C show a diagram of display packaging 100 as it would appear as it is stamped or embossed on three suitable flat sheets of packaging material, preferably corrugated cardboard, that is thick enough to support the doll and be folded as described herein. It is presently preferred that the enclosure box diagram of FIG. 4A has linear dimensions of approximately 10.125"×14"; the support base diagram of FIG. 4B has linear dimensions of approximately 5.5"×8.125"; and the doll support tower diagram of FIG. 4C has linear dimensions of approximately 9.093"×18.578". Larger or smaller versions of display packaging for correspondingly larger or smaller dolls may be stamped/embossed on other suitable sizes of packaging material that are large enough to accommodate the design of the display package while avoiding excess waste. The reverse side of the packaging material is printed with appropriate graphics, et cetera, as stated above.

Enclosure box 102 of FIG. 4A is constructed by cutting along cut lines 116 to form flaps which are folded inwardly along fold lines 118. The front and back opposing sides of the box are folded upward at fold lines 120 on opposing front and back bottom edges of the box. Fastening slots 122 on opposing sides of the box receive tabs 124 by folding the sides with the tabs inwardly along fold lines 126 and 128. Tabs 124 are preferably also taped to the box after being fastened within fastening slots 122 to provide additional closure support. Support base 104 of FIG. 4B is folded along fold line 130 and is inserted into a constructed enclosure box after an assembled doll support tower 106 is affixed to it as described herein below. The front and back edges of enclosure box 102 are illustrated herein as having generally upward arcuate edges, however any shape edge such as flat, downward arcuate or a fancy cut may be accommodated depending on the desired design printed on the box. The upward arcuate shape of the back edge of the box is particularly preferred for the back edge of the enclosure box.

Doll support tower 106 in FIG. 4C is constructed by inwardly folding all gripping support tabs 114 at the top of the tower along fold lines 132 and all the bottom securing tabs 134 at the bottom of the tower along fold lines 136. As shown in the figures herein the preferred shape of the top edges of the doll support tower features curves adjacent to the fold lines at the end of each edge of the pyramidal structure to as to avoid sharp edges, however any suitable line or curve may be used. The bottom front face 110 of the tower features gripping support structure 112 to grip and support the doll's legs in which center circle 138 is cut out and the remaining gripping pieces are cut along radial lines 140 and are folded downwardly when the doll's legs are inserted through the hole as shown in FIG. 2. The lower portion of the front face of the tower along with gripping support structure 112 is folded inwardly perpendicularly along fold line 141 to a substantially horizontal position. Tab 142 adjacent to gripping support structure 112 is inserted into slot 144 on one of the back faces of the tower and is folded into the slot along fold line 146 and preferably secured with tape. Cut line 148 forms a slot on the fold line adjacent to slot 144 through which tab 150 on the outer back face of the tower is inserted and folded along fold line 152 and is preferably secured with tape. The faces of the support tower are concomitantly folded along fold lines 154 to form the tower structure shown in FIGS. 1-4.

Doll support tower 102 is then affixed to support base 104 shown in FIG. 4B by inserting the three doll tower bottom securing tabs 134 into the three corresponding slots 135 on the top surface of the support base. The doll tower bottom securing tabs are taped or glued to the support base after being fastened within fastening slots 135 and the half of the support base without slots is folded downwardly away from the tower along fold line 130 and secured by tape or glue so that the doll support tower is securely attached to the support base. The support base with the attached doll support tower is then inserted into the support base in an orientation so that the bottom front face 110 of the tower having the opening due to the folded back portion as shown in FIG. 2 is facing the front side of the support base that a purchaser would see on a retail shelf. The support base is preferably taped or glued into the enclosure box to provide additional support.

The dimensions of the display packaging of this embodiment can generally be of any size depending on the size of the doll that is packaged, but preferably the enclosure box is approximately 4.125"×5.75" and the doll support tower is approximately 7" tall. Of course, as described above, any size of display packaging is contemplated herein to accommodate various sizes of dolls.

Figure 5:
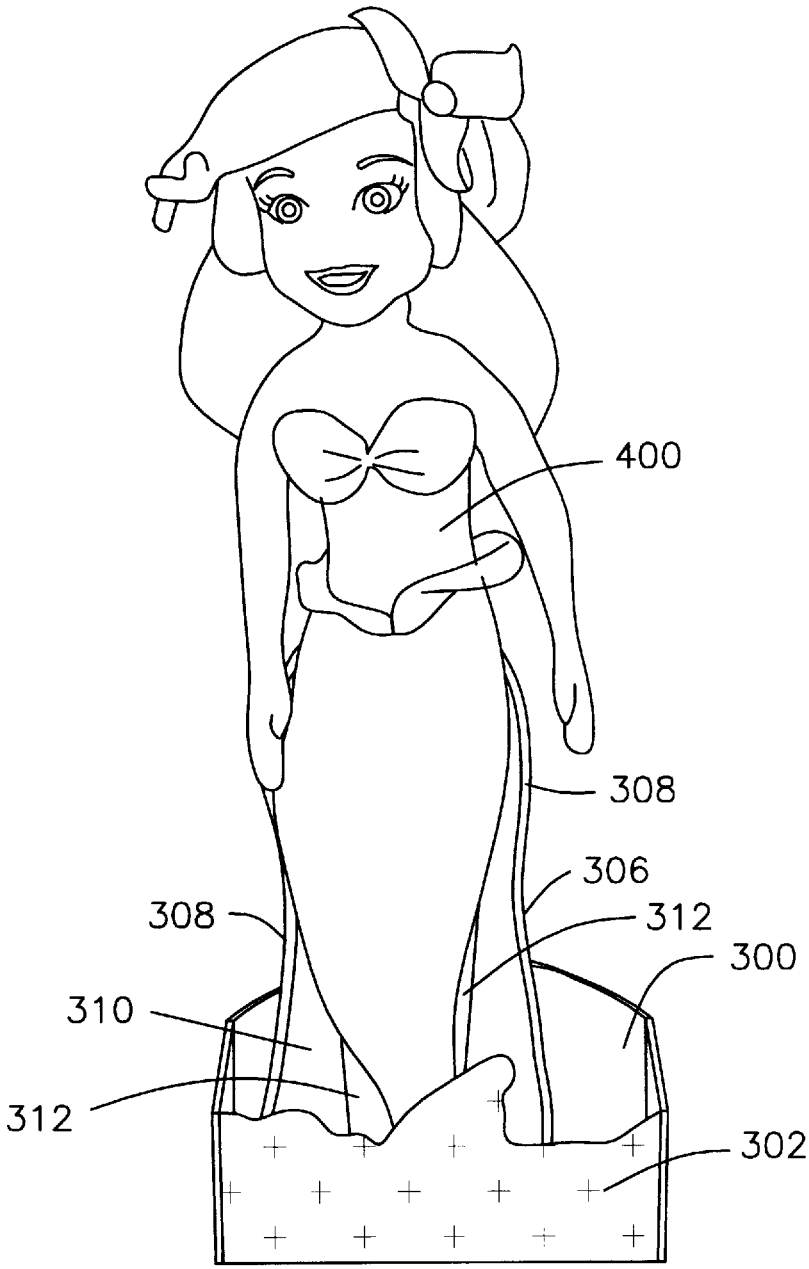
FIG. 5 shows a front view of an alternative embodiment of display packaging containing a soft doll that does not have legs in an upright position as it would sit on a retail shelf.

In another embodiment the display packaging can hold an imaginary creature, such as a mermaid, or another figure without legs and/or having non-human characteristics. As shown in FIG. 5, an embodiment of display package or packaging 300 is shown as it would sit on a shelf of a retail store shelf with soft doll 400 housed within. Enclosure box 302 with a generally flat bottom and four low sides is configured to receive a support base 304 (not shown) to which is affixed a doll support tower 306 in the form of a cradle structure that allows the lower part of the doll's figure to be visible when viewed frontally. The doll support tower has inwardly facing longitudinal tabs 308 formed on both sides of a substantially cutout back section 310 which together form the cradle structure which adds locking support to the front, sides, and back hips of the doll and provides stiff and stationary boundaries for the doll while otherwise keeping it open to showcase the lower portion of the doll. Additionally the inwardly folded longitudinal tabs on the doll support tower provide one or more locations to secure the doll to the packaging with one or more plastic securing tags or the like that are inserted to pierce through the upper parts of the cradle structure and the adjacent parts of the doll's hip areas. The cutout back section 310 of the cradle is mated to a fold-down support tab 312 which is downwardly folded and secured onto the support base to form a support for the lower extremities of the doll, a tail and fin in the case of a mermaid doll, and additionally serves to stabilize the packaging. The doll support tower has three tabs 314 on its lower edges (not shown) that fit into corresponding slots on the support base in addition to the fold-down-support tab 312 which is also secured onto the support base. As shown in FIG. 5 the doll support tower is affixed to the support base off center to accommodate the offset tail and fin of the mermaid as shown therein, however it is to be understood that the present packaging is by no means limited to that feature and any type of doll figure may be accommodated.

Figure 6:
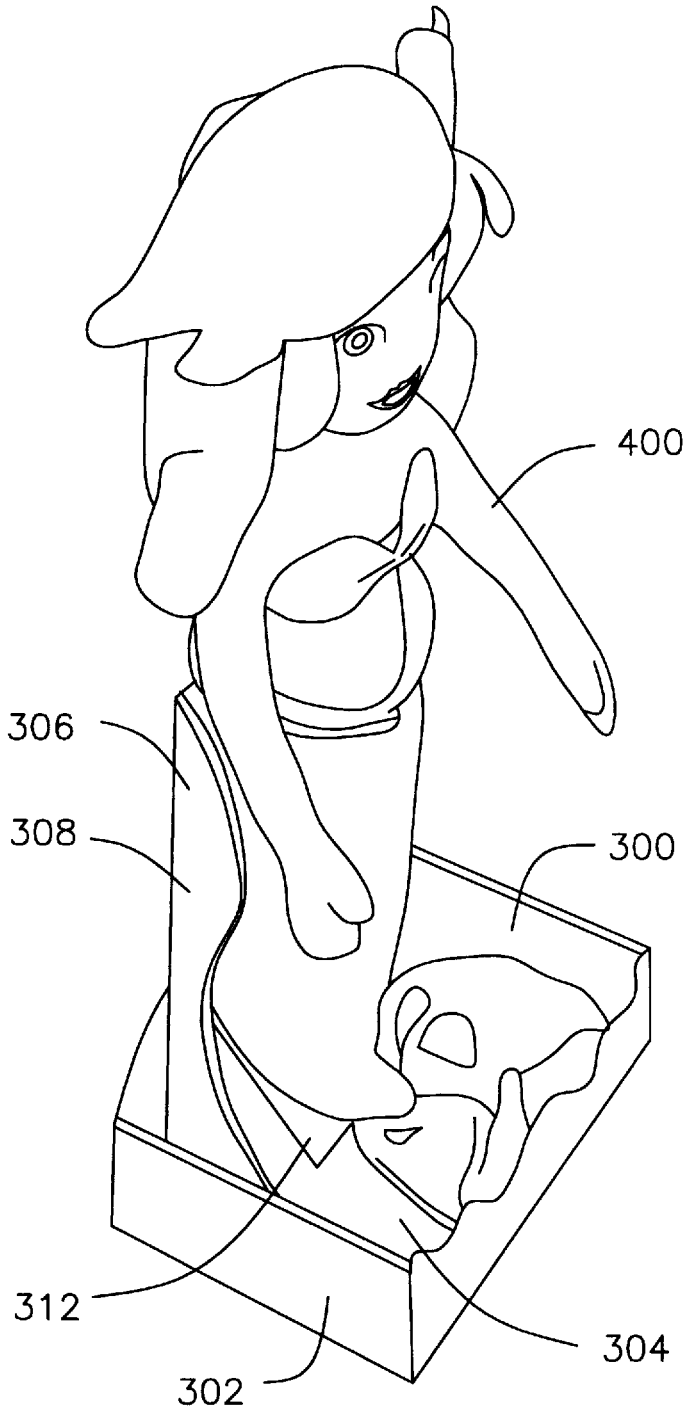
FIG. 6 shows a three quarter-side view of the packaging shown in FIG. 5.

As shown in FIG. 6, fold-down support tab 312 formed out of the lower portion 336 (shown in FIG. 7C) of the tower is downwardly folded over the upper portion 332 (shown in FIG. 7C) of the tower and is fastened into a slot in the base of support base 304 at an acute angle. The lower portion of the mermaid tail is supported by the fold-down support tab.

As stated above, the materials for making the display packaging disclosed herein are not limited, but it is preferred to use flat suitable material such as, but not limited to, corrugated cardboard, paper, or any other substantially rigid and/or resilient material. The surface of such materials may be capable of receiving or including graphical designs, a product description, trademark(s), bar code, or other indicia or printed material.

Figure 7A:
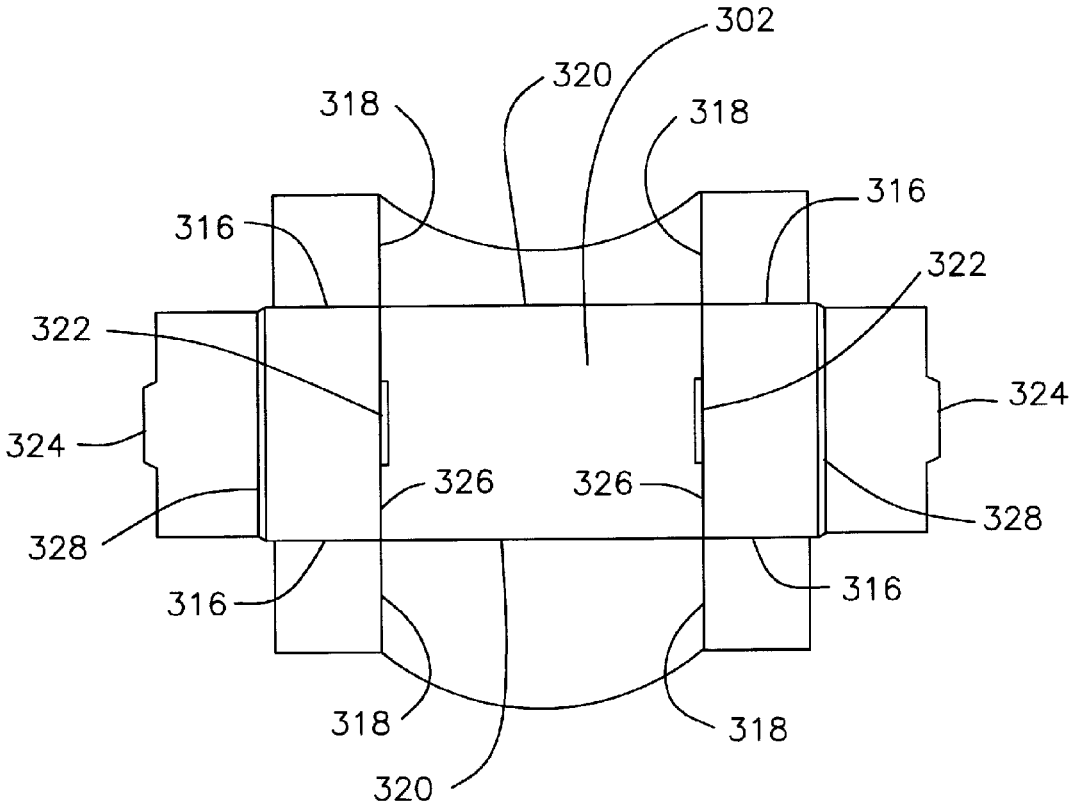
FIGS. 7A-7C are schematic drawings illustrating the structure of display packaging of FIGS. 5 and 6.
Figure 7C:
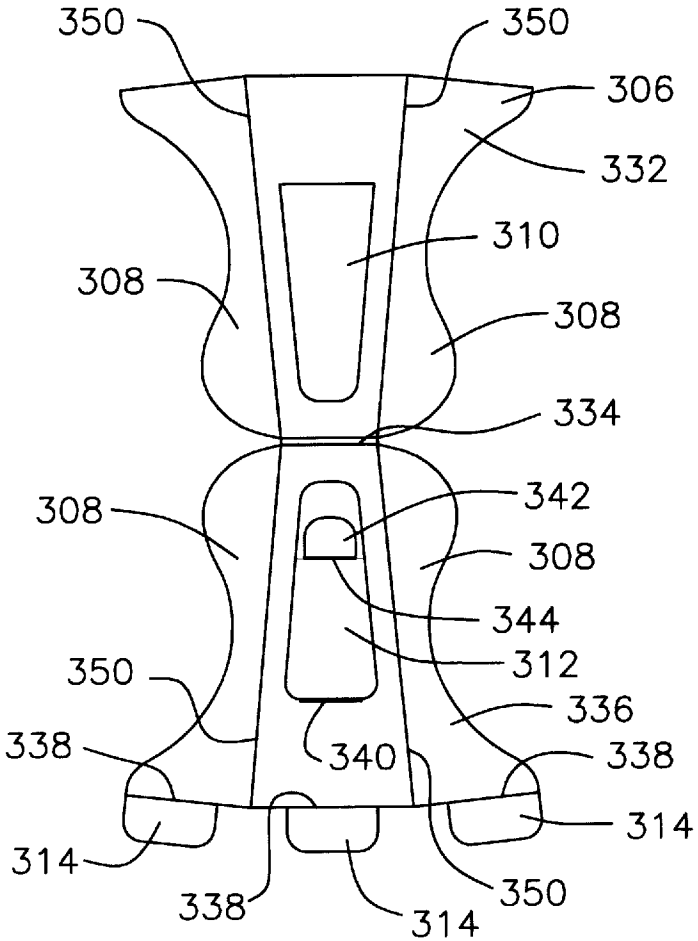
Figure 7B:
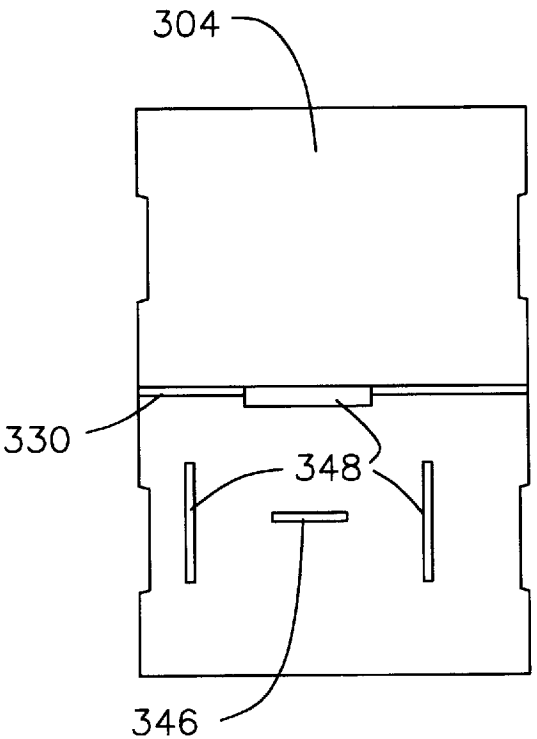

As an example of the process or method of making display packaging 300, FIGS. 7A-7C show a diagram of display packaging 300 as it would appear as it is stamped or embossed on three suitable flat sheets of packaging material, preferably corrugated cardboard, that is thick enough to support the doll and be folded as described herein. It is presently preferred that the enclosure box diagram of FIG. 7A has linear dimensions of approximately 14.125"; the support base diagram of FIG. 7B has linear dimensions of approximately 8.125"; and the doll support tower diagram of FIG. 7C has linear dimensions of approximately 8.315". Larger or smaller versions of display packaging for correspondingly larger or smaller dolls may be stamped/embossed on other suitable sizes of packaging material that are large enough to accommodate the design of the display package while avoiding excess waste. The reverse side of the packaging material is printed with appropriate graphics, et cetera, as stated above.

Enclosure box 302 of FIG. 7A is analogous to the enclosure box of the embodiment shown in FIG. 4A, but shows alternative shapes for the rear edge of the box, and it is to be understood that any shape or design for the front and rear edges that can be accommodated by the enclosure box is contemplated herein. Enclosure box 302 is constructed by cutting along cut lines 316 to form flaps which are folded inwardly along fold lines 318. The front and back opposing sides are folded upward at fold lines 320 on opposing front and back bottom edges of the box. Fastening slots 322 on opposing sides of the box receive tabs 324 by folding the sides with the tabs inwardly along fold lines 326 and 328. Tabs 324 are preferably also taped after being fastened within fastening slots 322 to provide additional closure support. Support base 304 of FIG. 7B is folded along fold line 330 and is inserted into a constructed enclosure box after a doll support tower 306 is affixed to it as described herein below.

Doll support tower 306 of FIG. 7C is constructed by folding the upper portion 332 of the tower at fold line 334 onto lower portion of the tower 336. Lower tower portion 336 is provided with three bottom securing tabs 314 that are ultimately folded upwardly on fold lines 338. Area 310 of the upper portion 332 of the tower is cut out to form cutout back section 310. Lower tower portion 336 is provided with a fold-down support tab 312 which is cut out of the lower tower portion and folded downwardly along fold line 340 after the two portions of the tower are folded together. Securing tab 342 at the end of the fold-down support tab is formed by folding along fold line 344. The area directly surrounding securing tab 342 is cut out to match the shape of the mirror image of the curved section of cutout back section 310 so that when the two sections of the tower are folded over, the shape of cutout back section 310 lines up with the space above fold-down support tab 312. The two superimposed sections are mated and secured to each other by virtue of the downward folding of fold-down support tab 312 through the cutout back section 310 of the upper tower portion. Fold-down support tab 312 is inserted into centermost slot 346 of support base 304 of FIG. 7B and the three bottom securing tabs 314 on the bottom of the doll support tower are inserted into the corresponding three slots 348 of support base 304. All the tabs are preferably secured by taping or gluing.

The dimensions of the display packaging of this embodiment can generally be of any size depending on the size of the doll that is packaged, but preferably the enclosure box is approximately 5.75"×4.125" and the doll support tower is approximately 4.125" tall. Of course, as described above, any size of display packaging is contemplated herein to accommodate various sizes of dolls.

Upon folding to bring the upper portion of the doll support tower over the lower portion and folding the fold-down support tab to secure the upper and lower portions together, longitudinal tabs 308 are each folded inwardly towards the fold-down support tab along fold lines 350 so as to face each other. Bottom securing tabs 314 of the doll support tower are then inserted into slots 348 of support base 304 and tab 342 of fold-down support tab 312 is also inserted into center slot 346 of support base 304 and secured by taping or gluing as described above. When so secured, the fold-down support tab forms an acute angle with respect to the support base that can serve to support the lower extremities of the doll. The top portion of the support base is then folded downwardly away from the tower along fold line 330 to cover the protruding tabs of the doll support tower and are secured by tape or glue to ensure the doll support tower is securely attached to the support base. The support base with the attached doll tower is then inserted into the support base oriented so that the cradle of the tower faces toward the front side of the support base that a purchaser would see on a retail shelf. The support base is preferably taped or glued into the enclosure box to provide additional support.

It will be readily appreciated that the present display packaging uses very little packaging material, preferably corrugated cardboard, and eliminates any freestanding large box. Thus the present packaging offers an improvement with respect to conservation.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

Although illustrative embodiments have been described herein with reference to the accompanying drawings, it is to be understood that the embodiments are not limited to those particular descriptions, and that various other changes and modifications may be affected therein by one skilled in the art without departing from the scope or spirit of the disclosure.

What is claimed is:

1. Display packaging for soft dolls, comprising:

an enclosure box;

a support base held within said enclosure box; and a doll support tower attached to said support base having a folded truncated pyramidal shape with upper gripping supports at the top of said support tower for gripping and supporting hips of a soft doll inserted therethrough and a middle gripping support element positioned horizontally at the midsection of said support tower for gripping supporting the legs of said soft doll inserted therethrough whereby any long dress of said soft doll is allowed to hang down and cover said doll support tower such that viewing of said soft doll is unimpeded by elements of said display packaging.

2. The display packaging of claim 1, wherein said upper gripping supports comprise gripping support tabs that are folded inwardly when the hips of said soft doll are inserted therethrough.

3. The display packaging of claim 1, wherein said middle gripping support element comprises a circular section with radial lines cut therethrough which fold downwardly to grip and support legs of said soft doll which are inserted therethrough which is formed on a lower front face of said pyramidal structure of said doll support tower.

4. The display packaging of claim 3, wherein said middle gripping support element is positioned by folding back and securing a lower portion of the lower front face of said pyramidal structure having said circular section with radial lines cut therethrough to a substantially horizontal position at the midsection of said doll support tower.

5. The display packaging of claim 1, wherein said doll support tower further comprises bottom securing tabs which are fastened into corresponding slots in said support base.

6. The display packaging of claim 1, wherein said packaging is made of corrugated cardboard.

7. A system, comprising:

a soft doll product; and display packaging for displaying said soft doll product in a standing position, said display packaging including a doll support tower extending upward from a support base and surrounding a bottom portion of the soft doll product such that the doll support tower supports the bottom portion and holds the soft doll product in the standing position, whereby viewing of said soft doll product, including costume and features of said soft doll product, is unimpeded by elements of said display packaging;

wherein said display packaging comprises:

an enclosure box;

the support base held within said enclosure box; and the doll support tower having a folded truncated pyramidal shape with upper gripping supports at the top of said support tower for gripping and supporting hips of said soft doll product inserted therethrough and a middle gripping support element positioned horizontally at the midsection of said support tower for gripping and supporting legs of said soft doll product inserted therethrough whereby any long dress of said soft doll product is allowed to hang down and cover said doll support tower.

8. The system of claim 7, wherein said upper gripping supports of said doll support tower comprise gripping support tabs that are folded inwardly when hips of said soft doll product are inserted therethrough.

9. The system of claim 7, wherein said middle gripping support element comprises a circular section with radial lines cut therethrough which fold downwardly when said legs are inserted therethrough which is formed on a lower front face of said pyramidal structure of said doll support tower.

10. The system of claim 7, wherein said middle gripping support element is positioned by folding back and securing a lower portion of the lower front face of said pyramidal structure having said circular section with radial lines cut therethrough to a substantially horizontal position at the midsection of said doll support tower.

11. The system of claim 7, wherein said doll support tower further comprises bottom securing tabs which are fastened into corresponding slots in said support base.

12. The system of claim 7, wherein said display packaging is made of corrugated cardboard.

13. Display packaging for soft dolls, comprising:

an enclosure box;

a support base held within said enclosure box; and a doll support tower attached to said support base having a folded cradle shape with inwardly facing longitudinal tabs formed on both sides of a back section for supporting hips of a soft doll placed within and a downwardly extending support tab formed from said back section for supporting lower extremities of said soft doll whereby viewing of said soft doll frontally is unimpeded by elements of said display packaging.

14. The display packaging of claim 13 wherein said doll support tower further comprises bottom securing tabs which are fastened into corresponding slots in said support base.

15. The display packaging of claim 13 wherein said downwardly extending support tab is fastened to a corresponding slot in said support base and forms an acute angle with respect to a back of said tower.

16. The display packaging of claim 13, wherein said packaging is made of corrugated cardboard.

17. The display packaging of claim 13, wherein said soft doll is releasably fastened to said inwardly facing longitudinal tabs and back of said doll support tower.

18. A system, comprising:

a soft doll product; and display packaging for displaying said soft doll product in an upright position, said display packaging including a doll support tower extending upward from a support base and surrounding a bottom portion of the soft doll product such that the doll support tower supports the bottom portion and holds the soft doll product in the upright position, whereby viewing of said soft doll product frontally is unimpeded by any elements of said display packaging;

wherein said display packaging comprises:

an enclosure box;

the support base held within said enclosure box; and the doll support tower having a folded cradle shape with inwardly facing longitudinal tabs formed on both sides of a back section for supporting hips of said soft doll product placed within in an upright position and a downwardly extending support tab formed from said back section for supporting the lower extremities of said soft doll product.

19. The system of claim 18, wherein said doll support tower further comprises bottom securing tabs which are fastened into corresponding slots in said support base.

20. The system of claim 18, wherein said downwardly extending support tab is fastened to a corresponding slot in said support base and forms an acute angle with respect to a back of said tower.

21. The system of claim 18, wherein said packaging is made of corrugated cardboard.

22. The system of claim 18, wherein said soft doll product is releasably fastened to upper portions of said inwardly facing longitudinal tabs and back of said doll support tower.

* * * * *